US006421501B2

(12) United States Patent
Berthou et al.

(10) Patent No.: US 6,421,501 B2
(45) Date of Patent: Jul. 16, 2002

(54) HEATER FOR RESISTIVE HEATING OF A FLUID, FLUID-TREATMENT APPARATUS INCORPORATING SUCH A HEATER, AND A METHOD OF TREATING A FLUID BY RESISTIVE HEATING

(75) Inventors: Marc Berthou, Saint Mammes; Christian Aussudre, Avon; Fabrice Chopard, Saint Martin d'Heres, all of (FR)

(73) Assignees: Electricite de France-Service National, Paris; Alfa Laval Vicarb, Fontanil Cornillon, both of (FR)

( * ) Notice: Subject to any disclaimer, the term of this patent is extended or adjusted under 35 U.S.C. 154(b) by 0 days.

(21) Appl. No.: 09/726,495

(22) Filed: Dec. 1, 2000

(30) Foreign Application Priority Data

Dec. 2, 1999 (FR) ..... 99 15215

(51) Int. Cl.[7] ..... F24H 1/00
(52) U.S. Cl. ..... 392/314; 392/338; 165/167
(58) Field of Search ..... 392/314, 321, 392/338, 490, 494, 495, 496, 484; 165/167, 66; 426/521, 522; 99/483

(56) References Cited

U.S. PATENT DOCUMENTS 535,267 A * 3/1895 Wagner et al. ..... 392/338
2,188,625 A * 1/1940 Dufour et al. ..... 392/314
2,314,966 A * 3/1943 Astle ..... 165/167
2,392,021 A * 1/1946 Wildermuth ..... 165/167
2,659,580 A * 11/1953 Hytte ..... 165/167
2,937,856 A * 5/1960 Thomson ..... 165/167
2,960,160 A * 11/1960 Goodman ..... 165/167
3,299,252 A * 1/1967 Meek ..... 392/314
3,414,436 A * 12/1968 Price et al. ..... 392/314
3,469,012 A 9/1969 Devaney
4,542,034 A * 9/1985 Aule et al. ..... 165/66
5,290,583 A * 3/1994 Reznik et al. ..... 426/614

FOREIGN PATENT DOCUMENTS

| | | |
|---|---|---|
| EP | 690660 | 1/1996 |
| FR | 1143495 | 10/1957 |
| FR | 9408108 | 1/1996 |
| WO | 9908482 | 2/1999 |

* cited by examiner

*Primary Examiner*—John A. Jeffery
(74) *Attorney, Agent, or Firm*—Birch, Stewart, Kolasch & Birch, LLP

(57) ABSTRACT

A resistive heater comprises at least one heater chamber defined by walls, two of which are constituted by parallel conductive plates spaced apart by a selected distance. The chamber also has an inlet for introducing a fluid close to a first end of the plates and an outlet placed close to a second end of the plates, opposite from the first, for collecting the fluid after it has flowed between the plates, parallel thereto, and devices are provided to power the plates with electricity so that the fluid is heated in the chamber by the resistive effect while it is flowing parallel to the plates.

17 Claims, 4 Drawing Sheets

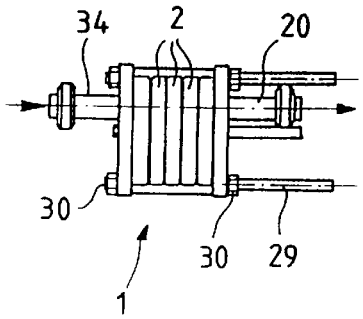
FIG_5
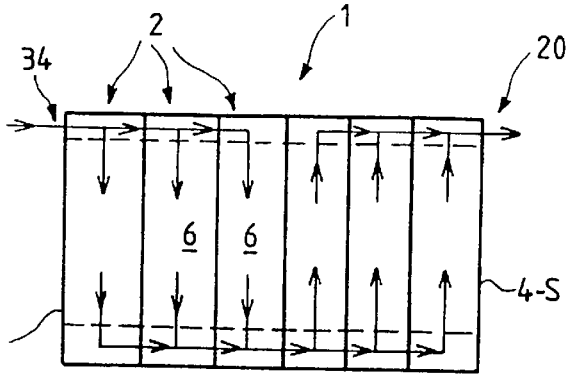
FIG_6
FIG_9
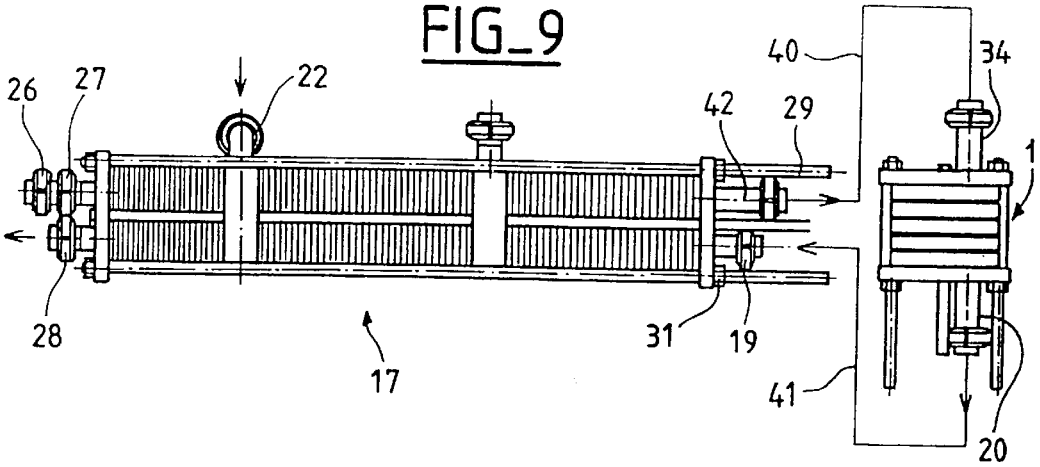
FIG_10
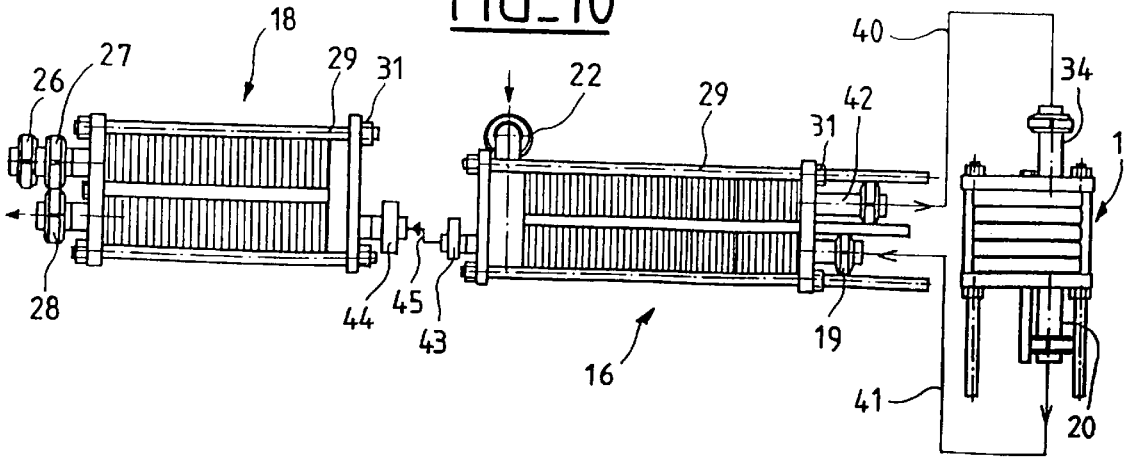

HEATER FOR RESISTIVE HEATING OF A FLUID, FLUID-TREATMENT APPARATUS INCORPORATING SUCH A HEATER, AND A METHOD OF TREATING A FLUID BY RESISTIVE HEATING

This application hereby claims priority of the French patent application FR 9915215 filed on Dec. 2, 1999.

FIELD OF THE INVENTION

The invention relates to the field of applying heat treatment to a fluid, and in particular heat treatments including at least one step of resistive heating.

BACKGROUND OF THE INVENTION

Although a very wide range of fluids can be concerned by such treatment, the invention relates more particularly to fluids in the food industry, and in particular those that need to be pasteurized or sterilized, for example.

Resistive heating is a well-known technique for heating throughout a volume by the Joule effect. It consists in setting up an electric current in an electric circuit that terminates at electrically-conductive plates, and in causing an electrically-conductive fluid to flow between the plates. Since the fluid presents a certain amount of electrical resistance, it produces heat by the Joule effect, and consequently "heats itself".

Patent document FR 94/08108 discloses a resistive heater comprising a tubular central channel with planar electrodes placed at each of its two ends, the electrodes being pierced to enable a fluid to penetrate into the tube and to be collected therefrom. Those two electrodes are perpendicular both to the channel and to the general flow direction of the fluid.

OBJECTS AND SUMMARY OF THE INVENTION

An object of the invention is to provide a solution that differs from known solutions.

To this end, the invention provides a resistive heater comprising at least one heater chamber defined by walls of which two are constituted by substantially parallel conductive plates that are spaced from each other by a selected distance. The chamber also comprises at least one inlet enabling the fluid to be heated to be introduced close to a first end of the plates, and at least one outlet placed close to the second end of the plates, opposite from the first end, and enabling the fluid to be collected after it has flowed between the plates, substantially parallel thereto. Means are also provided for feeding electricity to the plates so that the fluid heats in the chamber by the resistive effect as it flows parallel to the plates.

As a result, firstly a large volume of fluid can be treated, secondly a large amount of heating can be obtained by acting on the dimensions and the spacing of the plates, thirdly the amount of electrode clogging is low, and fourthly the heater is easy to clean.

In a preferred embodiment, each chamber of the heater comprises at least one spacer which defines the space between the plates and comprises a hollow central portion allowing the fluid to flow together with two side faces against which the plates are placed, which side faces are provided with openings to allow surface contact between the fluid and the plates.

Under such circumstances, it is particularly advantageous for the spacer to comprise, at opposite ends of the central portion, respectively a first end portion in which the fluid admission inlet is formed communicating with the hollow central portion, and a second end in which the fluid collection outlet is formed communicating with said hollow central portion.

Depending on requirements, the heater may comprise a single chamber or a plurality of chambers juxtaposed one beside another in leakproof manner. In a "series", first configuration, the chambers are juxtaposed in such a manner that the outlet of one chamber feeds the inlet of the following chamber, while the inlet of said chamber is itself fed by the outlet of the preceding chamber. The heater can thus be modular. In a "parallel/series", second configuration, the chambers are juxtaposed beside one another in leakproof manner so that their respective inlets communicate with one another and their respective outlets communicate with one another. More preferably, the heater comprises a first set of chambers and at least one second set of chambers, the outlet from one of the first and second sets feeding the inlets of the other of the second and first sets. Any combination of these two configurations can be envisaged.

Each chamber may comprise one or two or even more juxtaposed spacers, in particular for the purpose of varying the spacing between the electrodes.

It is also possible to envisage chambers having two or more inlets, and one or two outlets, or more outlets, so as to enable two or more flows to flow simultaneously.

The invention also provides fluid treatment apparatus incorporating the above-described resistive heater. More precisely, the apparatus comprises a heater for heating a first fluid coupled to a first heat exchanger having a first circuit in which the heated first fluid from the heater flows, and a second circuit in which a second fluid flows, the first and second circuits being placed relative to each other in such a manner that the first and second fluids exchange heat so as to lower the temperature of the first fluid and increase the temperature of the second fluid by respective selected amounts.

In a first embodiment of the apparatus, which has only a single heat exchanger portion, the first fluid is the heated fluid delivered at the outlet of the heater, while the second fluid is a cooling fluid.

In a second embodiment of the apparatus, the outlet of the heater still feeds the inlet of the first circuit of the first heat exchanger, however the outlet of the second circuit of said heat exchanger feeds the inlet of said heater. The first fluid is thus the fluid that has been heated by the heater while the second fluid is the fluid to be heated by the heater. The first heat exchanger thus serves simultaneously to pre-heat the fluid and pre-cool the same fluid after it has been heated.

In this second embodiment, the first heat exchanger is preferably housed between the heater and a second heat exchanger. The second heat exchanger has a third circuit through which the pre-cooled first fluid delivered from the outlet of the first circuit flows, and a fourth circuit through which a cooling third fluid flows, the third and fourth circuits being placed relative to each other in such a manner that the first and third fluids exchange heat so as to lower the temperature of the pre-cooled first fluid by a selected amount.

Each heat exchanger is preferably of the stacked plate type. The successive pairs of plates define fluid flow chambers, and the successive chambers define portions of two different circuits so as to enable heat to be exchanged between the fluids of the two circuits.

The first and second heat exchangers could constitute a single overall heat exchanger. In which case, it is advantageous for the stack of plates in the general heat exchanger and the heater chambers of the heater to present dimensions that are substantially identical. This enables the general heat exchanger and the heater to be assembled together in series so as to form a one-piece structure using fastening means such as tie bars associated with nuts.

However, the heater and the heat exchanger(s) could be physically separate, with coupling between them being obtained by connecting pipes.

The invention also provides a method of treating fluid by resistive heating, which method comprises the following steps.

In a first step, one or more heater chambers is/are provided, each comprising two walls constituted by conductive plates that are substantially mutually parallel and spaced apart from each other by a selected distance.

In a second step, electricity is fed to the plates.

In a third step, the fluid to be heated is introduced close to a first end of the plates and the fluid is then caused to flow between the plates, substantially parallel thereto, so as to be heated inside the chamber by the resistive effect, and finally the heated fluid is collected from close to a second end of the plates, opposite from the first end.

In particularly advantageous manner, after the third step, a fourth step can be provided of lowering the temperature of the first fluid by a selected amount by exchanging heat with a second fluid.

In a first application, during the fourth step, the first fluid is the heated fluid delivered from the outlet(s) of the heater chamber(s), while the second fluid is a cooling fluid.

In a second application, during the fourth step, the first fluid is the heated fluid delivered by the heater chamber(s), while the second fluid is the fluid that is to be heated by said heater chamber(s). Thus, the fluid is simultaneously pre-heated and pre-cooled after it has been heated.

In this second application, the method may comprise, after the fourth step, a fifth step of lowering the temperature of the pre-cooled first fluid by a selected amount by exchanging heat with a cooling third fluid.

BRIEF DESCRIPTION OF THE DRAWINGS

Other characteristics and advantage of the invention will appear on examining the following detailed description and the accompanying drawings, in which:

FIG. 5 is a plan view of a resistive heater of the type shown in FIG. 1, once assembled;

FIG. 6 is a diagram showing how fluid flows in a variant of the heater having a plurality of chambers;

FIG. 9 shows a first variant of the FIG. 7 apparatus in which the heater is associated with a heat exchanger by tubular coupling; and FIG. 10 shows a second variant of the FIG. 7 apparatus in which the heater is associated with a first heat exchanger for pre-cooling and pre-heating the fluid to be treated, which is in turn associated with a second heat exchanger for cooling the pre-cooled fluid, with coupling being performed on both occasions by tubular coupling.

DETAILED DESCRIPTION OF THE PREFERRED EMBODIMENTS

The accompanying drawings are essentially certain in character. Consequently, they can serve not only to illustrate the invention, but also to contribute to defining the invention, where appropriate.

In the following description, reference is made to a heater and to apparatus for treating a fluid. More precisely, reference is made to a fluid used in the food industry, for example milk. Naturally, this is merely one possible application, and it is not limiting.

Figure 1:
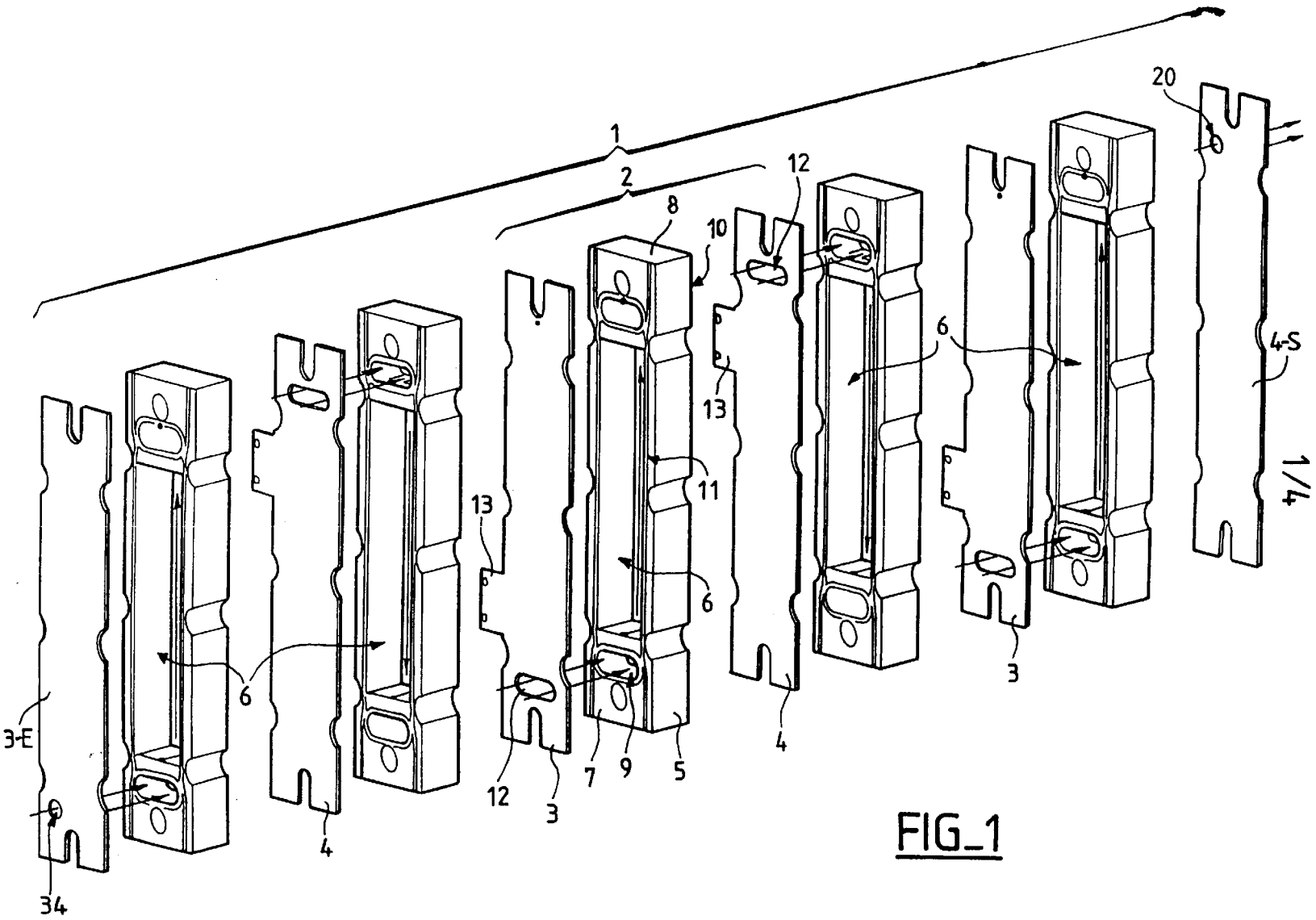
FIG. 1 is an exploded view of a resistive heater of the invention, having a plurality of chambers.
Figure 2:
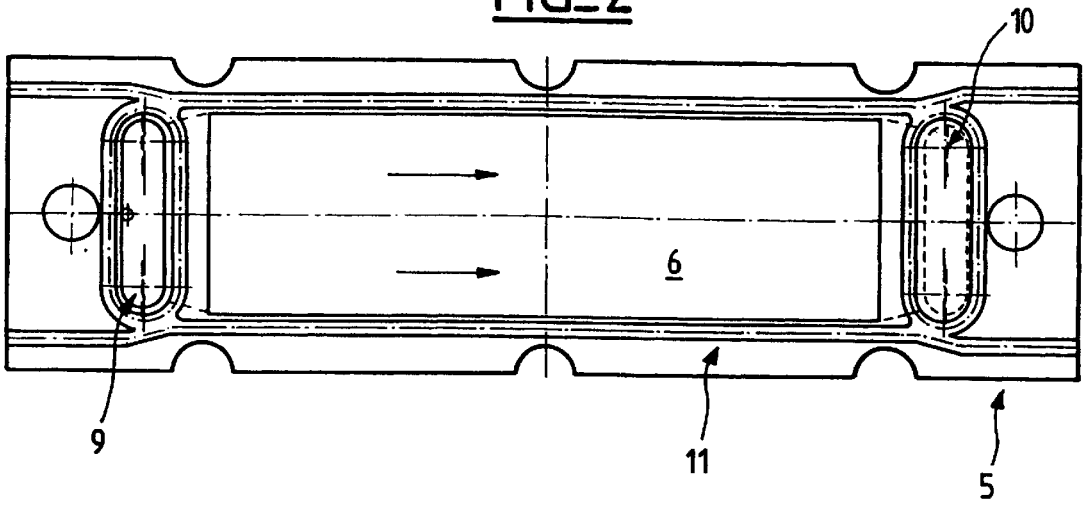
FIG. 2 is a front view of a spacer of the type used in the heater of FIG. 1.

Reference is made initially to FIG. 1 to describe a resistive heater of the invention. In the example shown, the heater is made up of five heater chambers that are juxtaposed to one another and that communicate with one another. Consequently, the heater is of the multi-chamber type, however it need have only a single chamber. In other words, the number of chambers in a heater of the invention can be varied depending on requirements.

A chamber 2 is defined by two plates 3, 4 made of a conductive material, preferably metal, and a spacer 5 for determining the spacing between the two conductive plates 3 and 4. More preferably still, these plates are of the dimensionally stable anode (DSA) type. Such anodes are described in particular in European patent application 99 400 623.7.

In the example shown in FIG. 1, the spacer 5 is a three-dimensional element having a hollow central portion 6 between two end portions 7 and 8 in which a fluid admission inlet 9 and a fluid collection outlet 10 are respectively formed, each communicating with the hollow central portion 6.

The spacer 5 is made of an insulating material, e.g. a polymer, and more preferably of poly-ether-ether-ketone (PEEK). However numerous other insulating materials could be envisaged. The way in which the spacers are made depends on the material(s) used: machining and/or welding and/or molding.

In this example, the admission inlet 9 and the collection outlet 10 are both substantially L-shaped. Furthermore, the conductive plates 3 and 4 preferably have dimensions that are substantially equal to the dimensions of the side faces 11 of the spacer 5. Consequently, to introduce the fluid to be heated into the chamber 6, and likewise to evacuate the collected and heated fluid from the chamber 6, each conductive plate 3, 4 has an opening 12 at one of its two ends.

It is thus possible to use the same type of plate on both sides of the spacer 5, thus making it possible to reduce cost significantly.

Each conductive plate constitutes an electrode for being powered electrically by an appropriate circuit (not shown) or else grounded (as applies in this example to the end plates 3-E and 4-S). This power supply can be provided, for example, via a lateral tab 13 provided on each of the plates 3, 4.

Since the purpose of the heater is to heat a fluid flowing inside the central portion 6 of the chamber 2 by the Joule effect, the side faces 11 of the spacer are consequently open so that the fluid can make contact with (i.e. run over) the electrode-forming conductive plates 3 and 4. As a result, the fluid which flows substantially parallel to the plates, between the admission inlet 9 and the collection outlet 10 establishes a "connection" between the two conductive plates, thereby causing said fluid to become heated because of its resistivity.

By using a plurality of heater chambers, it is possible to raise the temperature of the fluid progressively up to a given value. Thus, temperatures of 180° C. can be obtained. Clearly, as shown in FIG. 1, flow along successive chambers takes place in alternating directions. In other words the spacers are disposed in alternating manner so that the collection outlet of one spacer feeds the admission inlet of the next.

The overall power supply to the various conductive plates is preferably performed in a "triangular" type mode in which the end plates 3-E and 4-S are respectively connected to ground whereas the intermediate plates 3 and 4 are placed at selected potentials, e.g. 50 volts (V) or 100 V.

This is the presently preferred power supply mode. In this power supply mode, the fluid admission chamber and the fluid collection chamber respectively including the end plates 3-E and 4-S that are grounded, do not serve to heat the fluid but instead to prevent possible leakage of electricity. In a variant, both of the plates 3 and 4 defining the first and last chambers of the heater (including the end plates 3-E and 4-S, respectively) can be grounded. Under such circumstances, the first and last chambers act as isolating chambers. However the configuration could be different.

By way of example, the power fed to the heater can be about 6 kilowatts (kW) in three-phase for a flow rate of 300 liters per hour (l/h), or 120 kW for a flow rate of 6000 l/h.

Naturally, apart from the inlet and outlet end plates 3-E and 4-S, each conductive plate 3, 4 is used simultaneously by two successive chambers 6, so that the opening 12 through the plate at one of its two ends simultaneously constitutes an admission opening and a collection opening.

Figure 3:
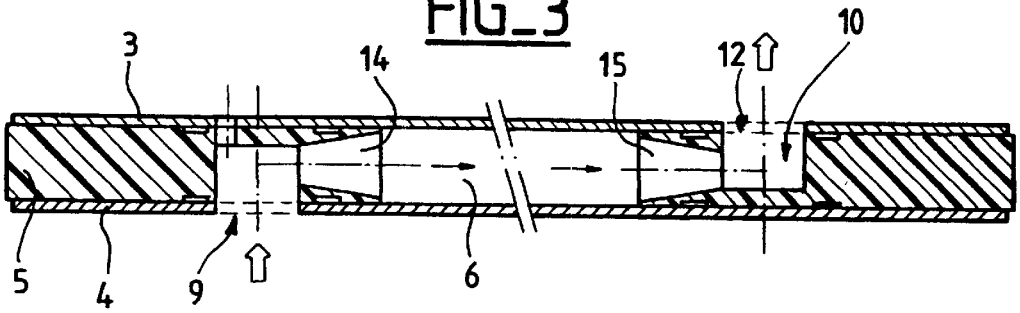
FIG. 3 is a cross-section view of a variant chamber of the heater.
Figure 4:
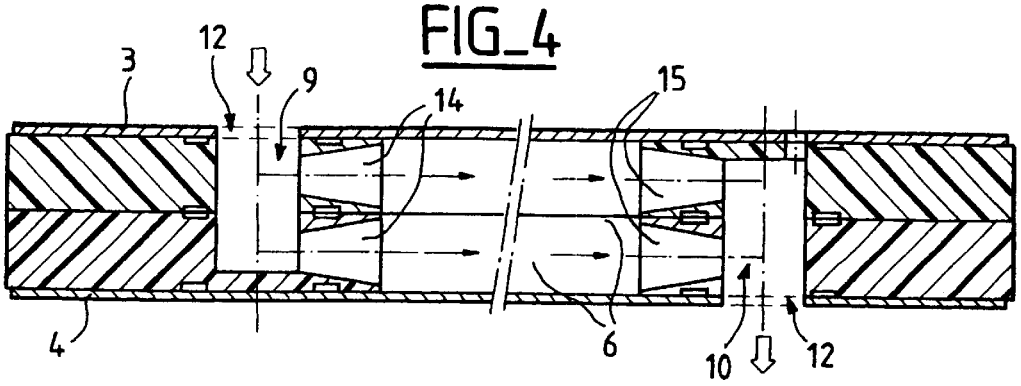
FIG. 4 is a cross-section view of another variant chamber of the heater presenting two flows.
Figure 7A:
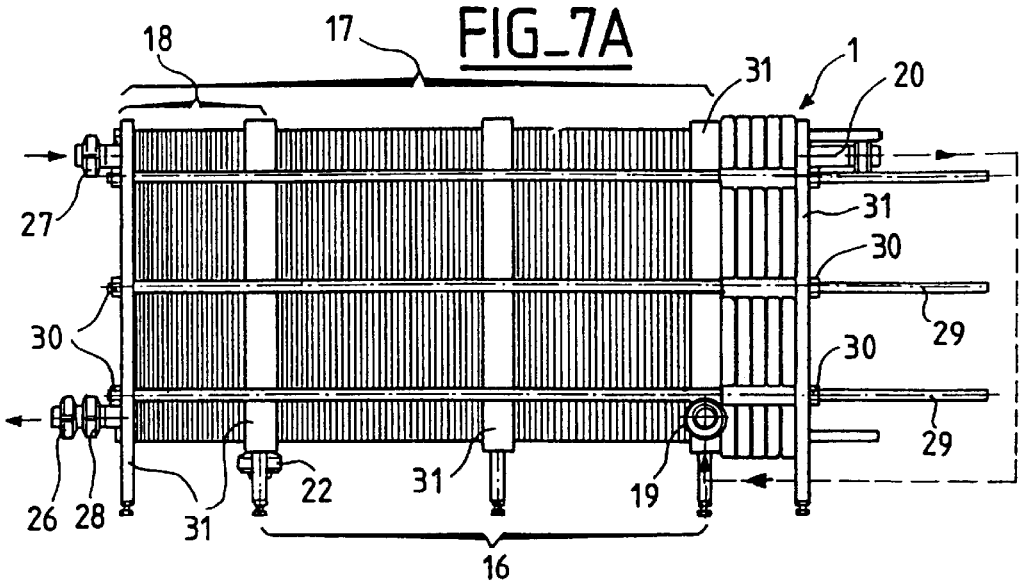
FIGS. 7A to 7D are respectively a side view (A), a plan view (B), a front end view (C), and a rear end view (D) of apparatus of the invention.
Figure 7B:
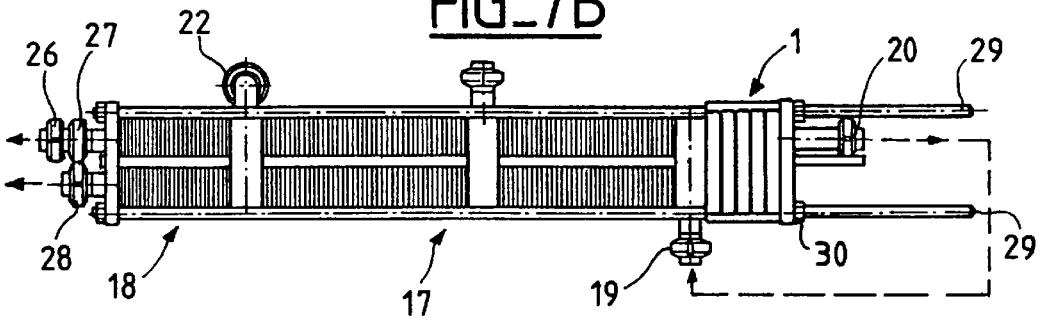
Figure 7C:
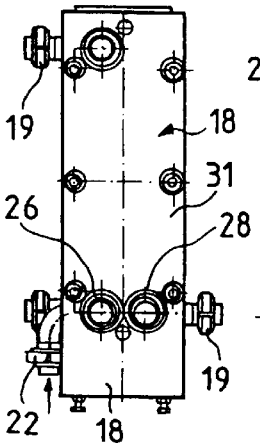
Figure 7D:
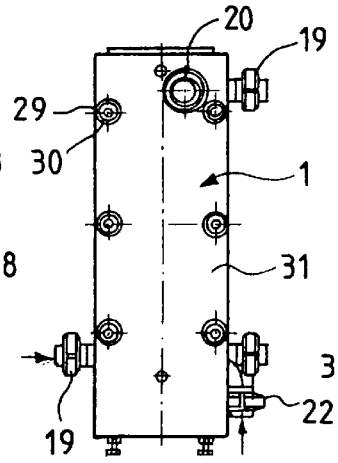

Reference is now made to FIGS. 3 and 4 to describe two variant embodiments of a heater chamber of the heater of the invention.

In the example shown in FIG. 3, the spacer still has a heater chamber 6 fed via an admission inlet 9 and feeding a collection outlet 10. In this case, the portions of the admission inlet 9 and of the collection outlet 10 which open out into the hollow portion of the chamber 6 are implemented in the form of "divergent" elements, thereby enabling the distribution of fluid inside the chamber to be improved and enabling its collection at the outlet from the chamber likewise to be improved.

In the variant shown in FIG. 4, the spacing between the conductive plates 3 and 4 is considerably increased, by using a double spacer, or better still, as shown in FIG. 4, two spacers that are superposed and head to tail. In this case, as in the example shown in FIG. 3, each spacer includes a divergent element 14, 15. As a result, the flow which penetrates via the admission inlet 9 is split into two subflows. It would also be possible to envisage superposing three or more spacers, so as to set up three or more flows. Naturally, the flows communicate with one another inside the heater chamber 6 so that electricity can flow between the two conductive plates 3 and 4. In this embodiment, in particular, it is possible to provide a plurality of fluid admission inlets and/or a plurality of fluid collection outlets, including in each chamber.

FIG. 5 shows a resistive heater assembled by using fastening means such as tie bars 29 having nuts 30 screwed onto the ends thereof. The plates and the spacers are thus assembled together with applied pressure. The heater has a fluid admission inlet 34 leading to a first chamber 2 (the chamber having the plate 3-E), and an outlet 20 from which the heated fluid is collected coming from a last chamber 2 (including the plate 4-S).

The flow of fluid inside the heater can either be fully alternating (up/down/up/down . . . ), which corresponds to "series" flow as mentioned above, or else it can alternate in part (a plurality of parallel "downs" followed by a plurality of parallel "ups" or vice versa), as shown in FIG. 6, which corresponds to "parallel/series" type flow. In this case, the heater has a first portion which feeds a second portion. In the example shown, the first portion has three chambers fed in parallel with fluid from the top, the fluid then flowing along each chamber and being collected at the bottom. The second portion has three chambers fed in parallel with the fluid coming from the first portion, via the bottom, and the fluid then flows along each chamber to be collected at the top so as to feed the outlet 20 from the heater.

More generally, any combination of series and parallel/series modes can be envisaged.

Reference is now made to FIGS. 7A to 7D to describe an embodiment of fluid treatment apparatus of the invention. Such apparatus is particularly advantageous in applications where it is necessary firstly to heat a fluid to a given temperature, e.g. 140° C. in order to-sterilize it or pasteurize it, and secondly to lower its temperature to a second value, lower than the first, e.g. in order to package it.

For this purpose, it is therefore necessary to provide apparatus comprising a heater of the type described above with reference to FIGS. 1 to 6, coupled to one or two heat exchangers. The term "coupling" is used herein to cover either "integration" in which the heater and the heat exchanger(s) together form a one-piece type assembly (as shown in FIG. 7), or else "association" in which the heater and the heat exchanger(s) are connected to one another by pipes or hoses (as shown in FIGS. 9 and 10).

FIGS. 7A to 7D show an embodiment of apparatus of the invention in which the heater 1 is coupled in line to a general heat exchanger 17 having two "stages" (or two portions). The first stage 16 (or first portion, or indeed first heat exchanger) is used both for pre-heating the fluid that is to be raised to the first temperature by the heater 1, and for pre-cooling the fluid that has just been heated by the heater 1, so as to bring it down to an "intermediate" temperature.

The second portion 18 is used to cool the fluid which has just been pre-cooled by the first portion 16 of the heat exchanger 17, so as to bring it down to a second temperature.

For this purpose, the first portion 16 of the general heat exchanger 17 adjacent to the heater 1, preferably has an inlet 19 fed with heated fluid from the outlet 20 of the heater 1. This inlet 19 feeds a first circuit 21 (see FIG. 8) which feeds cooled fluid coming from the first portion 16 to the second portion 18 which is described below. The first portion 16 has another inlet 22 preferably placed opposite from the inlet 19, i.e. beside the second portion 18 of the heat exchanger 17. This inlet 22 feeds a second circuit 23 which preferably has flow alternating with that of the heated fluid which flows inside the first circuit. The first and second circuits 21 and 23 are arranged in such a manner as to enable heat to be exchanged between the heated fluid and the cold fluid that is to be pre-heated.

Figure 8:
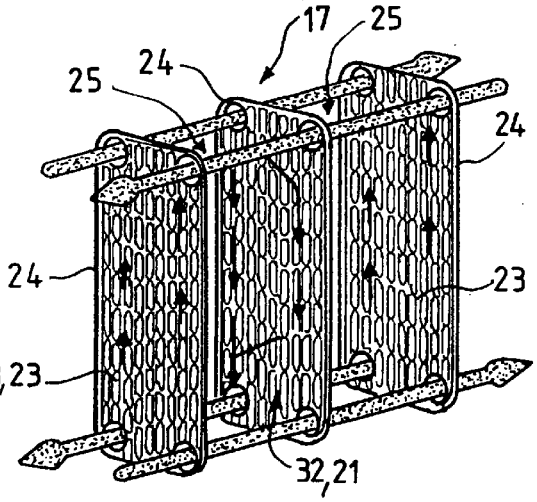
FIG. 8 is a diagrammatic exploded view showing the respective flows of two fluids in independent circuit portions of a heat exchanger of the apparatus.

Preferably, and as shown in FIG. 8, the first portion 16 of the heat exchanger 17 is constituted by a stack of plates 24, pairs of which define chambers 25 in which the two types of fluid flow (the heated fluid and the fluid to be heated).

Advantageously, and in order to encourage heat exchange between the two fluids, the stacked plates are of the corrugated type.

Corrugated plates 24 of this type are well known to the person skilled in the art. Consequently, there is no need to describe them in detail. All that needs to be said here is that the fluid which is heated at its flows inside the first circuit 21 from the inlet 19 towards the outlet 43 feeding the second portion 18 loses heat to the fluid that is to be heated which flows through the second circuit 23 from the inlet 22 towards the heater 1.

The second portion 18 of the heat exchanger 17 is preferably made in the same way as the first portion 16. It thus comprises a series of stacked plates 24 which in pairs define heat exchange chambers. More precisely, the pre-cooled fluid flows in a third circuit 32 which terminates at an outlet 26. To cool this pre-cooled fluid, a fourth circuit 33 is provided likewise constituted by the stack of corrugated plates 24. The fourth circuit 33 is fed with a cooling fluid via an inlet 27 placed at an end face of the heat exchanger 17 remote from the heater 1, and opening out at an outlet 28 which, in the example shown in FIGS. 7A to 7D, is likewise located at said face opposite from the heater 1.

As a result, the pre-cooled fluid flowing in the third circuit 32 from the outlet 43 of the first portion 16 towards the outlet 27 loses heat to the cooling fluid which flows in the fourth circuit 33 between its inlet 27 and its outlet 28.

It is clear that the dimensions of the heat exchanger, and the number of cooling chambers that it includes will vary depending on requirements.

In particularly advantageous manner, as illustrated in FIGS. 7A to 7D, the heater 1 has transverse dimensions that are substantially identical to those of the general heat exchanger 17. In other words, the transverse dimensions of the stacked corrugated plates 24, of the spacers 5, and of the conductive plates 3 and 4 are substantially identical. Only the cheek plates defining the end plates of the heat exchanger and/or of the heater may possibly be slightly different in dimension, should that be necessary, e.g. for fixing purposes, or to provide sufficient strength.

This makes it possible to build up a one-piece apparatus in which the heat exchanger 17 and the heater 1 are mounted in line or in series and are assembled together simultaneously using fastening means such as tie bars 29 with nuts 30 screwed onto the ends thereof. Thus, by pressing the plates and the spacers against one another, a leakproof assembly is made which does not require any other bonding. Naturally, it is entirely possible to envisage using heat exchangers having brazed plates. Nevertheless, a heat exchanger comprising a stack of plates held together merely by being pressed against one another is very easy to clean. Furthermore, that makes it possible to implement apparatuses that are modular.

As shown more clearly in FIGS. 7A to 7D, the apparatus preferably includes collector boxes 31, firstly at each of its ends and secondly at the interfaces between the portions of the heat exchanger and between the heat exchanger and the heater, which collector boxes 31 are preferably implemented in the form of special bulging plates optionally including reinforcement that provides larger volumes for fluid flow.

The apparatus of the invention can be configured in numerous ways, particularly concerning the locations of its inlets and outlets.

A particularly advantageous variant consists in using a heat exchanger comprising a single portion only. Two circumstances can be envisaged.

In a first application, the fluid which flows in the second circuit 23 is the fluid to be heated. This fluid is consequently pre-heated by the fluid which has just been heated in the heater 1, which fluid flows in the first circuit 21 and is itself pre-cooled by the fluid flowing in the second circuit 23.

In a second application, the fluid flowing in the second circuit 23 is a cooling fluid, and the fluid to be heated is fed directly to the inlet 34 of the heater 1. In this case, it is clear that the fluid to be heated is not pre-heated, and that the heated fluid is not pre-cooled, i.e. it is cooled directly by the cooling fluid.

Reference is now made to FIGS. 9 and 10 while describing two variant embodiments of apparatus of the invention. These are variants in which coupling between the heater and the heat exchanger(s) takes place via associated pipes instead of within an integrated assembly as in FIGS. 7A to 7D.

In the embodiment shown in FIG. 9, two pipes 40 and 41 couple (associate) the heater 1 to a general heat exchanger 17 having two stages 16 and 18. The outlet 42 from the second circuit 23 of the first portion 16 of the heat exchanger 17 feeds pre-heated fluid via the pipe 40 to the inlet 34 of the heater 1, while the outlet 20 of the heater feeds heated fluid via the pipe 41 to the inlet 19 of the first circuit 21 of the first portion 16 of the heat exchanger 17.

The heater 1 is thus an element of the apparatus that is mechanically independent from the heat exchanger 17 with which it co-operates by means of the fluid. The general heat exchanger is thus assembled separately from the heater 1, e.g. by means of tie bars 29 and nuts 31.

In the embodiment shown in FIG. 10, two pipes 40 and 41 couple (associate) the heater 1 with a first heat exchanger 16. The outlet 42 from the second circuit 23 of the first heat exchanger 16 feeds pre-heated fluid via the pipe 40 to the inlet 34 of the heater 1, while the outlet 20 of the heater feeds heated fluid via the pipe 41 to the inlet 19 of the first circuit 21 of the first heat exchanger 16.

The first heat exchanger 16 is coupled (associated) by a pipe 45 to a second heat exchanger 18 for cooling the pre-cooled fluid. The outlet 43 from the first circuit 21 of the first heat exchanger 16 feeds pre-cooled fluid via the pipes 45 to the inlet 44 of the third circuit 32 of the second heat exchanger 18. The cooled fluid leaves the third circuit 32 via the outlet 28.

The heater 1 is thus an element of the apparatus which is mechanically independent from both the first and the second heat exchangers 16 and 18 with which it co-operates by means of the fluid to be heated. The two heat exchangers are thus assembled separately from each other, e.g. by means of tie bars 29 and nuts 31. Furthermore, as shown in FIG. 10, the dimensions of the two heat exchangers are not necessarily the same. It can be advantageous, for example, for the second heat exchanger to be larger in section than the first.

The invention also provides a method of treating fluid by resistive heating. This method comprising the steps specified below.

In a first step, one or more heater chambers of the type described above with reference to FIGS. 1 to 6 are provided. Consequently, each chamber has two walls constituted by conductive plates that are substantially parallel to each other and that are spaced apart from each other by a selected distance. Naturally, it is particularly advantageous for two successive heater chambers to share a common conductive plate.

In a second step, the conductive plates are electrically powered.

In a third step, the fluid to be heated is introduced close to a first end of the conductive plates and then made to flow between the plates substantially in parallel thereto so as to be heated inside the chambers by the resistive effect. Finally, the fluid heated in this way is collected from the vicinity of a second end of the plates, remote from the first end. Naturally, when a plurality of chambers are used, the fluid is fully heated once it reaches the outlet of the last chamber.

As described with reference to the apparatus, the method may include a fourth step coming after the third step in which the temperature of the first fluid is reduced to a selected value by exchanging heat with a second fluid. This second fluid can either be a cooling fluid, or the fluid to be heated itself, in which case the fluid to be heated is pre-heated by the first fluid.

Under such circumstances, provision can be made after the fourth step for a fifth step in which the temperature of the first fluid which has been pre-cooled during the fourth step is cooled to a new selected value by exchanging heat with a cooling third fluid.

The invention is not limited to the implementations of the heater, the apparatus, and the method as described above, purely by way of example, but covers any variant that can be envisaged by the person skilled in the art within the ambit of the following claims.

Thus, a multi-chamber resistive heater is described. However it is clear that the heater could comprise a single heater chamber only. Similarly, the heat exchanger in the apparatus described above is of the multi-chamber (or "multi-pass" type), however it need have only one chamber for each circuit.

Furthermore, the described application of the heaters, apparatuses, and methods of the invention, relates to food industry fluids, and in particular to milk. Nevertheless, it is clear that the invention can be applied to numerous other fluids, including fluids in fields other than the food industry.

What is claimed is:

1. A heater for resistive heating of a liquid, the heater comprising a stack of parallel superposed plates, said plates comprising conductive plates and non-conductive spacer plates that are applied onto one another in a liquid-tight manner and that define consecutive heater chambers, wherein each heater chamber comprises two conductive plates and at least one spacer plate between said two conductive plates, a liquid inlet slot formed in one of said two conductive plates, an inlet channel formed at a first end of said spacer plate and communicating with the liquid inlet slot, an outlet channel formed at a second end of the spacer plate opposite to the first end, a liquid outlet slot formed in the other of said conductive plates and communicating with the outlet channel, and a central aperture formed in the spacer plate and communicating with the inlet and outlet channels, so that the liquid passing through the heater chamber flows parallel to the conductive plates in the central aperture of the spacer plate and is in contact with the conductive plates.

2. A heater according to claim 1, having a set of chambers juxtaposed against one another in leakproof manner so that the outlet of one chamber feeds the inlet of the following chamber, while the inlet of said chamber is itself fed by the outlet of the preceding chamber.

3. A heater according to claim 2, wherein adjacent chambers share a common plate.

4. A heater according to claim 1, having a set of chambers juxtaposed against one another in leakproof manner in such a manner that their respective inlets communicate with one another and their respective outlets communicate with one another.

5. A heater according to claim 4, having at least a first set of chambers and a second set of chambers, the outlet from one of said first and second sets feeding the inlet of the other of said second and first sets.

6. A heater according to claim 1, wherein at least two consecutive heater chambers are connected in series so that the liquid flows in opposite directions in the two consecutive chambers.

7. A heater according to claim 1, wherein at least two consecutive heater chambers are connected in parallel, so that the liquid flows in the same direction in both consecutive chambers.

8. A heater according to claim 1, wherein the inlet and outlet channels in the spacer plate are L-shaped.

9. A heater according to claim 1, comprising at least one heater chamber in which the said two conductive plates are separated from each other by at least two juxtaposed spacer plates.

10. A heater according to claim 1, wherein the conductive plates and the spacer plates are secured together and pressed against one another by tie bars which are perpendicular to said plates.

11. A heater according to claim 1, wherein the conductive plates in the heater chambers are identical with one another.

12. Fluid treatment apparatus, comprising a resistive heater according to claim 1 for heating a first fluid and coupled to a first heat exchanger having a first circuit in which said heated first fluid flows coming from the heater, and a second circuit in which a second fluid flows, said first and second fluids being placed relative to each other in such a manner that the first and second fluids exchange heat so as to lower the temperature of the first fluid and increase the temperature of the second fluid by selected amounts.

13. Apparatus according to claim 12, wherein the outlet of the heater feeds the inlet of the first circuit of the first heat exchanger and the outlet of the second circuit of the first heat exchanger feeds the inlet of the heater, such that said first fluid is the fluid heated by the heater and said second fluid is the fluid that is to be heated by said heater, said first heat exchanger thus simultaneously pre-heating a first portion of the fluid and pre-cooling a second portion of the same fluid that has already been heated.

14. Apparatus according to claim 12, comprising a second heat exchanger having a third circuit in which said pre-cooled first fluid delivered by said outlet of the first circuit flows, and a fourth circuit in which a cooling third fluid flows, said third and fourth circuits being placed relative to each other in such a manner that the first and third fluids exchange heat so as to reduce the temperature of the pre-cooled first fluid by a selected amount.

15. Apparatus according to claim 14, wherein said first and second heat exchangers constitute two portions of a single general heat exchanger.

16. Apparatus according to claim 15, wherein the stacked plates of the general heat exchanger and the heater chambers of the heater present dimensions that are substantially identical such that said heat exchanger and said heater can be assembled together in series by fastening means thereby forming a one-piece structure.

17. Apparatus according to claim 16, wherein the fastening means includes tie bars each having a nut screwed onto at least one end thereof.

* * * * *